United States Patent [19]

Deffayet

[11] Patent Number: 4,876,963

[45] Date of Patent: Oct. 31, 1989

[54] HIGH PENETRATION ANTI-RUNWAY BOMB

[75] Inventor: Jean Deffayet, Chaville, France

[73] Assignee: Thomson-Brandt Armements, Boulogne-Billancourt, France

[21] Appl. No.: 232,239

[22] Filed: Aug. 15, 1988

[30] Foreign Application Priority Data

Aug. 14, 1987 [FR] France ..... 87 11583

[51] Int. Cl.[4] ..... F42B 25/02

[52] U.S. Cl. ..... 102/387; 102/374

[58] Field of Search ..... 89/1.11; 102/374, 387, 102/386, 382, 398

[56] References Cited

U.S. PATENT DOCUMENTS

| | | | |
|---|---|---|---|
| 1,838,035 | 12/1931 | Elia | 102/387 |
| 2,333,558 | 11/1943 | Gay | 102/387 |
| 2,377,587 | 6/1945 | Strong | 102/387 |
| 2,856,851 | 10/1958 | Thomas | 102/374 |
| 3,112,906 | 12/1963 | Zeyher | 102/387 |
| 3,724,373 | 4/1973 | Rivenes | 102/387 |
| 3,897,730 | 8/1975 | Riparbelli | 102/374 |
| 3,935,817 | 2/1976 | Riparbelli | 102/374 |
| 4,488,487 | 12/1984 | Croizer | 102/382 |
| 4,637,313 | 1/1987 | Henderson et al. | 102/398 |

FOREIGN PATENT DOCUMENTS 1267100 of 0000 Fed. Rep. of Germany .

OTHER PUBLICATIONS

Revue Internationale De Defence, vol. 14, No. 6, 1981, pp. 781–784, cointrin–Geneve, CH; C. Gilson: "La famille des armes air–siol de Brandt", p. 783, colonne de droite, La bombe anti–piste BAP 100.

*Primary Examiner*—David H. Brown

*Attorney, Agent, or Firm*—Cushman, Darby & Cushman

[57] ABSTRACT

The invention relates to bombs intended to be released at a very low altitude so as to damage high mechanical resistance surfaces and more particularly antirunway bombs equipped with a downward or acceleration propulsive unit. Each bomb comprises means for braking and orienting it during its initial fall, so as to position the bomb in a plane activating an upward propulsive unit. These means are formed of at least one parachute placed at the head of the bomb. With the activation position reached, the upward propulsive unit causes the bomb to rise and, during the final fall of said bomb, a downward propulsive unit, placed in front of the upward propulsive unit, accelerates the final fall of the bomb so as to accumulate high kinetic energy at the time of impact on the ground.

5 Claims, 4 Drawing Sheets

HIGH PENETRATION ANTI-RUNWAY BOMB

BACKGROUND OF THE INVENTION

The present invention relates to anti-runway bombs equipped with a downward or acceleration propulsive unit and, more generally, bombs intended to damage high mechanical resistance surfaces such as aerodrome runways used for taking off and landing of aircraft.

Referring to FIG. 1, an operating mode of antirunway bombs known up to now is shown by aircraft 1 and the trajectory shown with broken lines T1, appearing in the lower part of the diagram. The operating principle is the following. The aircraft 1, with or without pilot, flies over the runway or strip 2 to be damaged and releases one (or more) bombs. The aircraft continues its travel independently of that of the released bomb 3. The bomb subjected to the Earth's gravity, to air resistance and to the speed acquired on board the aircraft, describes the trajectory referenced T1. Bomb 3 is equipped with a parachute braking system 4. Once its speed is sufficiently close to the vertical, a downward propulsive unit is activated for driving and accelerating the fall of the bomb, and increasing the impact energy of the latter on the runway 2.

This operating procedure will no longer be possible in the short term:

on the one hand because of the improvement in the means for detecting firing from air-air defence systems which will force aircraft to fly over their objectives at a very low altitude (less than 50 m), on the other hand because of the improvement in penetration resistance of runways which will compel bomb constructors to confer thereon a higher kinetic energy.

Now, the above described operating procedure causes a loss of altitude of 30 to 40 m at the end of the parachute braking phase. If the release altitude is less than 50 m, there is not enough height for operating a propulsive unit from which an even higher power is expected. In fact, the operating height of the propulsive unit is equal to $(V_o+V_1/2)\times T$ where $V_o$ is the vertical component of the initial speed at the time of ignition of the propulsive unit, $V_1$ the final speed of the propulsive unit and T the combustion time. Now, $V_1$ must be sufficiently high so as to obtain the kinetic energy required for piercing the runway, e.g. 350 m/s. Furthermore, in the present state of the art, a propulsive unit cannot be constructed operating with a combustion time less than 0.20s having acceptable dimensions and a moderate cost price. In the example cited, if $V_o=10$ m/s and $V_1=350$ m/s, the propulsion height is 36 m, and if only 10 to 20 m are available another solution must then be found for the propulsive unit to be fully efficient.

The object of the invention is to overcome these drawbacks by providing an anti-runway bomb operating with a different operating mode and keeping an essential property of the operation : accuracy.

The invention provides an anti-runway bomb intended to be released at very low altitude, equipped with a downward propulsive unit, further comprising means for braking and orienting said bomb during its initial fall, so as to position the bomb in a plane activating an upward propulsive unit.

BRIEF DESCRIPTION OF THE DRAWINGS

The invention and its characteristics will be better understood from the following description and the accompanying figures in which.

DESCRIPTION OF THE PREFERRED EMBODIMENTS

Figure 1:
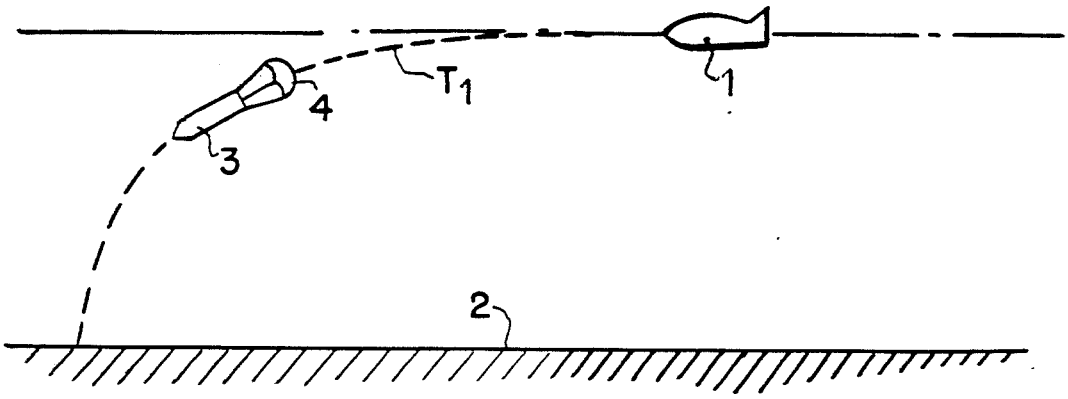
FIG. 1 (PRIOR ART)
FIG. 1 is a diagram of the operating mode of antirunway runway bombs of the prior art.

Referring to FIG. 1, the prior art trajectory, such as described above, is a direct trajectory, namely the bomb 3 reaches the ground very rapidly. According to the invention the bomb, after its release and initial fall, is caused to gain height, e.g. 100 to 200 m, so as to accumulate during a final fall and with the help of the downward propulsive unit, sufficient kinetic energy for an operational impact on the runway.

Figure 2:
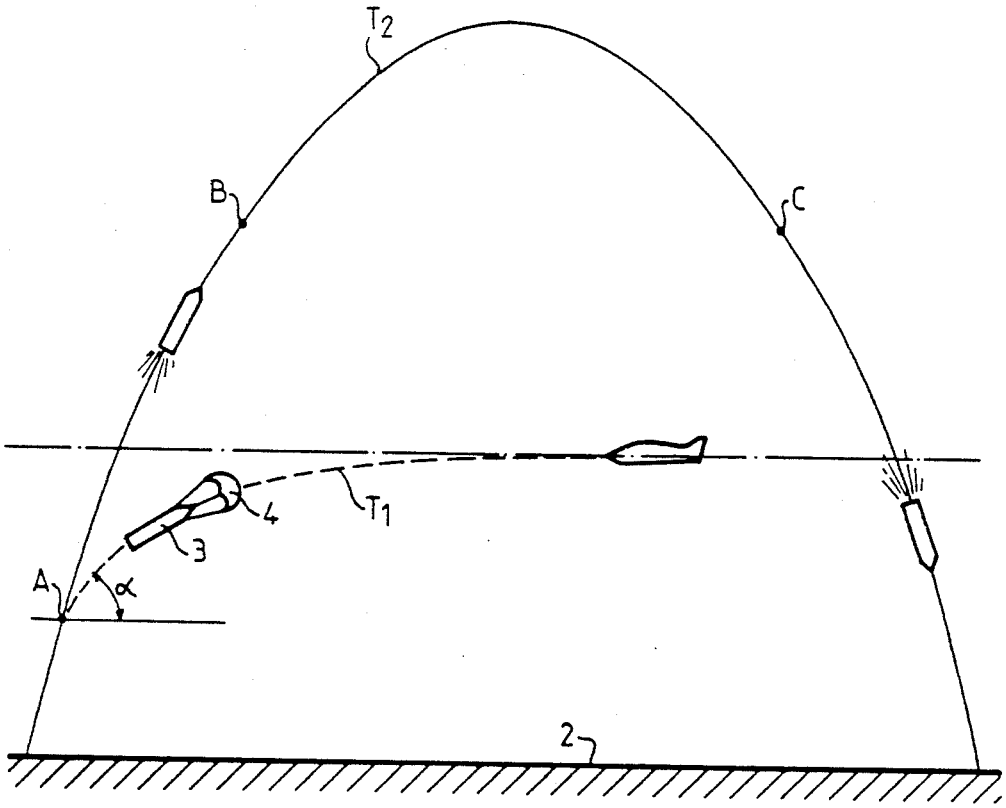
FIG. 2 shows a diagram of an operating mode of anti-runway bombs according to the invention.
Figure 3:
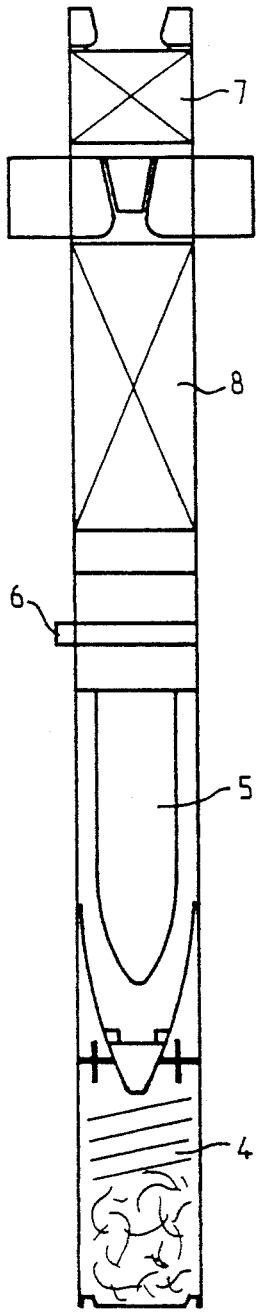
FIG. 3 is one possible construction of the bomb of the invention.

Referring to FIG. 3, the means used for putting this operation into practice, are formed by one or more parachutes 4 placed at the front of the bomb so as to brake it and orientate it. Thus, the bomb describes the first part $T_1$ of its trajectory in a reversed position, described further on. Other means also consist in disposing, behind the usual downward propulsive unit, an upward propulsive unit 7. The latter is triggered at point A, shown in FIG. 2 once the bomb has lost sufficient longitudinal speed to assume a sufficiently large angle of inclination $\alpha$ with respect to the horizontal , e.g. about 50° or 60°, so that the bomb may gain height along trajectory $T_2$ of FIG. 2, shown with a continuous line.

It is preferable to have two lateral parachutes 4, so that they do not disturb the upward movement of the bomb.

The upward propulsive unit 7 operates as far as point B in trajectory $T_2$ and the bomb begins its final fall by gravity effect.

The downward propulsive unit 8 is started up at point C of trajectory $T_2$ over a much greater height, so for a much longer time than when the bomb is simply released from the aircraft without upward propulsive unit, thus making the acquisition of sufficient kinetic energy possible.

Figure 4A:
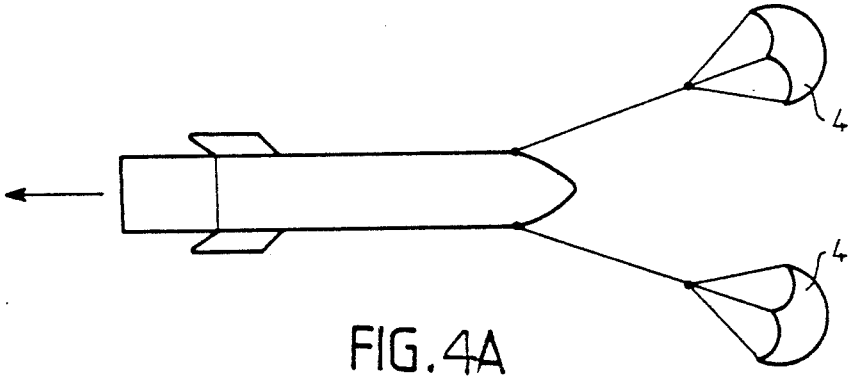
FIGS. 4A, 4B and 4C show the different positions of the bomb of the invention, after release.

FIG. 4A shows the bomb after release, before reaching point A. Parachutes 4 placed at the front of the bomb brake its fall and hold it in its reversed position.

Figure 4B:
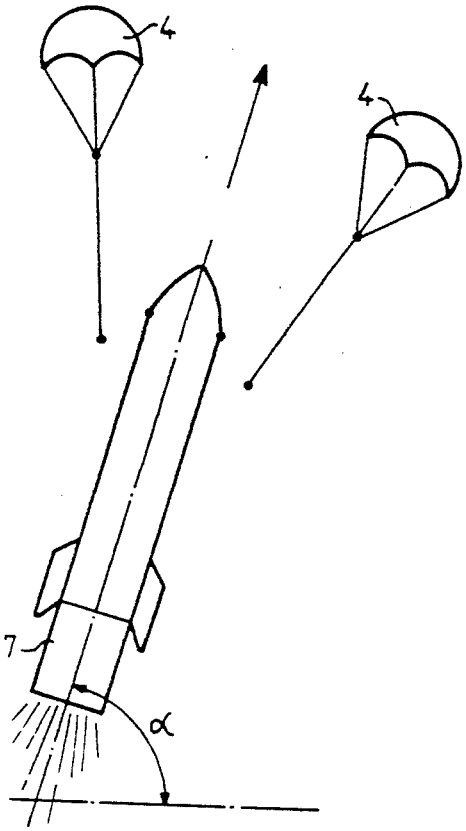

FIG. 4B shows the same bomb in the position corresponding to the beginning of the upward movement phase just after point A. The upward propulsive unit 7 drives the bomb upwards. Parachutes 4 are detached.

Figure 4C:
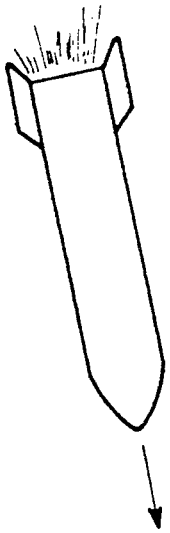

FIG. 4C shows the bomb during its final fall. The upward propulsive unit has been released. The downward propulsive unit accelerates the fall of the bomb.

In FIG. 3, the bomb is shown with its parachutes 4, placed at the head, in front of the ammunition 5. An engagement system 6 may be provided. Behind is located the downward propulsive unit 8 and finally behind the latter the upward propulsive unit 7.

It should be noted that this construction is not much more cumbersome than that of traditional type bombs, the upward propulsive unit 7 not requiring a large volume.

What is claimed is:

1. An anti-runway bomb intended to be released at a very low altitude, equipped with a downward propulsive unit and comprising means for braking and orienting said bomb during its initial fall so as to position the bomb in a plane, and an upward propulsive unit activated when said bomb is positioned in said plane.

2. The anti-runway bomb as claimed in claim 1, wherein said upward propulsive unit includes means for activating the upward propulsive unit at a specific time when it has a specific angle of inclination with respect to the horizontal.

3. The anti-runway bomb as claimed in claim 1, wherein said upward propulsive unit is placed at the rear of the anti-runway bomb behind the downward propulsive unit.

4. The anti-runway bomb as claimed in claim 1, wherein said means for braking and orienting comprise at least one parachute placed in front of the bomb so as to reverse a position of the bomb.

5. The anti-runway bomb as claimed in claim 4, wherein there are two of said parachutes.

* * * * *